US011798495B2

(12) United States Patent
Park et al.

(10) Patent No.: US 11,798,495 B2
(45) Date of Patent: Oct. 24, 2023

(54) DISPLAY DEVICE INCLUDING A TIMING CONTROLLER TO SUPPLY AN ADJUSTMENT OPTION VALUE THROUGH A DATA CLOCK SIGNAL LINE AND A METHOD OF DRIVING THE SAME

(71) Applicant: SAMSUNG DISPLAY CO., LTD., Yongin-si (KR)

(72) Inventors: Chae Hee Park, Yongin-si (KR); Jong Soo Kim, Yongin-si (KR); Heen Dol Kim, Yongin-si (KR); Ji Ye Lee, Yongin-si (KR); Young Suk Jung, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/873,365

(22) Filed: Jul. 26, 2022

(65) Prior Publication Data

US 2023/0162692 A1 May 25, 2023

(30) Foreign Application Priority Data

Nov. 19, 2021 (KR) ..... 10-2021-0160754

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0426* (2013.01); *G09G 2300/0842* (2013.01); *G09G 2310/08* (2013.01); *G09G 2320/0626* (2013.01); *G09G 2330/021* (2013.01); *G09G 2330/026* (2013.01)

(58) Field of Classification Search
None
See application file for complete search history.

(56) References Cited

U.S. PATENT DOCUMENTS

| | | | |
|---|---|---|---|
| 7,898,518 | B2 | 3/2011 | Hong et al. |
| 7,948,465 | B2 | 5/2011 | Cho et al. |
| 8,314,763 | B2 | 11/2012 | Park et al. |
| 8,330,699 | B2 | 12/2012 | Hong et al. |
| 9,589,524 | B2 | 3/2017 | Park |
| 10,950,197 | B2 | 3/2021 | Pyun et al. |

(Continued)

FOREIGN PATENT DOCUMENTS

| | | |
|---|---|---|
| KR | 10-1322119 | 10/2013 |
| KR | 10-1323703 | 10/2013 |

(Continued)

*Primary Examiner* — Krishna P Neupane
(74) *Attorney, Agent, or Firm* — F. Chau & Associates, LLC

(57) ABSTRACT

A display device including: a timing controller configured to supply an adjustment option value through a data clock signal line during a first initialization period, and generate second data based on first data and a control signal and supply the second data through the data clock signal line during a data period; a data driver configured to generate an adjustment value based on the adjustment option value during the first initialization period, and generate third data based on the adjustment value and the second data and generate a data signal based on the third data during the data period; and a pixel configured to display an image based on the data signal.

14 Claims, 13 Drawing Sheets

(56) References Cited

U.S. PATENT DOCUMENTS

| | | | | |
|---|---|---|---|---|
| 2006/0284816 | A1* | 12/2006 | Jang | G09G 3/3688 345/98 |
| 2015/0213779 | A1* | 7/2015 | Baek | G09G 5/008 345/204 |
| 2017/0092216 | A1* | 3/2017 | Park | G09G 3/2074 |
| 2019/0304397 | A1* | 10/2019 | Im | G09G 3/3685 |
| 2020/0312260 | A1* | 10/2020 | Kim | G09G 3/3696 |

FOREIGN PATENT DOCUMENTS

| | | |
|---|---|---|
| KR | 10-1325435 | 11/2013 |
| KR | 10-1367279 | 2/2014 |
| KR | 10-1988920 | 6/2019 |
| KR | 10-2020-0034863 | 4/2020 |
| KR | 10-2020-0074618 | 6/2020 |
| KR | 10-2151949 | 9/2020 |

* cited by examiner

DISPLAY DEVICE INCLUDING A TIMING CONTROLLER TO SUPPLY AN ADJUSTMENT OPTION VALUE THROUGH A DATA CLOCK SIGNAL LINE AND A METHOD OF DRIVING THE SAME

CROSS-REFERENCE TO RELATED APPLICATION

The present application claims priority under 35 U.S.C. § 119 to Korean patent application number 10-2021-0160754 filed on Nov. 19, 2021, the disclosure of which is incorporated by reference herein in its entirety.

TECHNICAL FIELD

Various embodiments of the present disclosure relate to a display device and a method of driving the display device.

RELATED ART

A display device is an output device for presentation of information in visual form. A display device may include a timing controller and a data driver. The timing controller and the data driver may transmit/receive signals required to drive the display device through an interface between the timing controller and the data driver.

For example, the timing controller may supply a clock training signal and frame data to the data driver through the interface. Here, when the data rate of the interface increases, signal distortion (or signal loss) in signals that are provided to the data driver may be severe enough to degrade the signals.

To compensate for signals distorted this way, the data driver may include an adjustment circuit (e.g., an equalizer or the like).

SUMMARY

Various embodiments of the present disclosure are directed to a display device in which the number of signal lines for signal transmission is minimized.

Furthermore, various embodiments of the present disclosure are directed to a display device which improves a data rate for an adjustment option value required for an adjustment circuit, such as an equalizer.

An embodiment of the present disclosure may provide a display device including: a timing controller configured to supply an adjustment option value through a data clock signal line during a first initialization period, and generate second data based on first data and a control signal and supply the second data through the data clock signal line during a data period; a data driver configured to generate an adjustment value based on the adjustment option value during the first initialization period, and generate third data based on the adjustment value and the second data and generate a data signal based on the third data during the data period; and a pixel configured to display an image based on the data signal.

The adjustment option value has two signal levels.

The second data has four signal levels.

The data driver includes: a receiver configured to receive the adjustment option value and the second data through the data clock signal line, and generate a clock signal and frame data based on the adjustment option value and the second data; and an image processor configured to generate the data signal based on the clock signal and the frame data.

The receiver includes: an equalizer controller configured to generate the adjustment value using the adjustment option value during the first initialization period; an equalizer configured to generate the third data by compensating for the second data using the adjustment value during the data period; and a clock recovery circuit configured to recover the clock signal based on the third data during the data period and a data recovery circuit configured to recover the frame data based on the third data during the data period.

The equalizer controller generates the adjustment value using a plurality of option codes included in the adjustment option value.

The data driver stores the adjustment value and supplies the adjustment value to the timing controller through a feedback line during the first initialization period.

The timing controller includes: a memory configured to store the adjustment value supplied through the feedback line.

The timing controller supplies the adjustment value to the data driver through the data clock signal line during a second initialization period.

The adjustment value supplied through the data clock signal line has two signal levels.

The adjustment value supplied through the data clock signal line has four signal levels.

The data driver supplies a feedback signal to the timing controller through the feedback line when the stored adjustment value is deleted.

The timing controller supplies the adjustment value to the data driver through the data clock signal line in response to the feedback signal during the second initialization period.

An embodiment of the present disclosure may provide a method of driving a display device including a timing controller and a data driver, the method including: supplying, by the timing controller, an adjustment option value to the data driver through a data clock signal line during a first initialization period; generating, by the data driver, an adjustment value based on the adjustment option value during the first initialization period; generating, by the timing controller, second data based on first data and a control signal and supplying the second data to the data driver through the data clock signal line during a data period; generating, by the data driver, third data based on the adjustment value and the second data and generating a data signal based on the third data during the data period; and displaying an image based on the data signal.

The adjustment option value has two signal levels.

The second data has four signal levels.

The method further including: supplying, by the data driver, the adjustment value to the timing controller through a feedback line during the first initialization period.

The method further including: supplying, by the timing controller, the adjustment value to the data driver through the data clock signal line during a second initialization period.

The adjustment value supplied through the data clock signal line has two signal levels.

The adjustment value supplied through the data clock signal line has four signal levels.

DETAILED DESCRIPTION OF THE EMBODIMENTS

Figure 1:
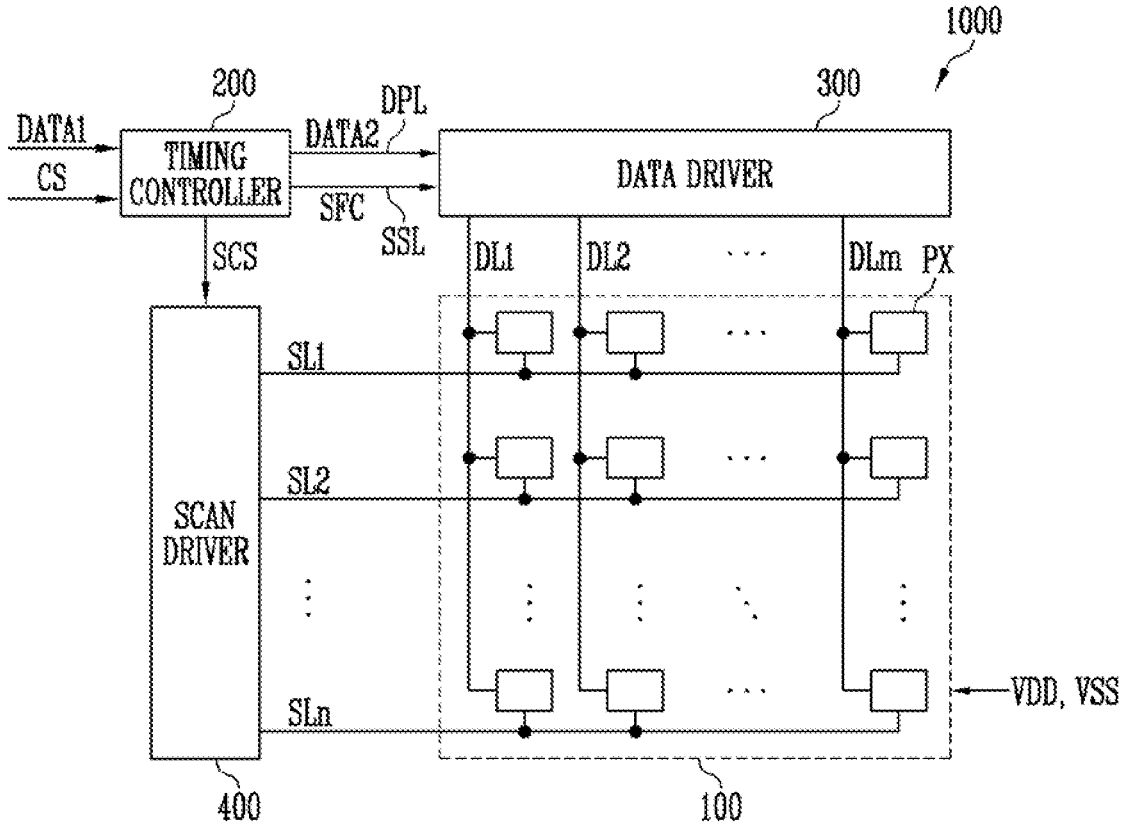
FIG. 1 is a block diagram illustrating a display device according to an embodiment of the present disclosure.

Hereinafter, embodiments of the present disclosure will be described in detail with reference to the accompanying drawings. The same reference numerals are used to designate the same or similar components throughout the drawings, and repeated descriptions thereof will be omitted.

FIG. 1 is a block diagram illustrating a display device according to an embodiment of the present disclosure.

Referring to FIG. 1, a display device 1000 according to an embodiment of the present disclosure may include a pixel component 100 (or a display panel), a timing controller 200, a data driver 300, and a scan driver 400.

The pixel component 100 may include a plurality of scan lines SL1 to SLn (where n is an integer greater than 0), a plurality of data lines DL1 to DLm (where m is an integer greater than 0), and a plurality of pixels PX.

Each of the pixels PX may be coupled to at least one of the scan lines SL1 to SLn and at least one of the data lines DL1 to DLm. Each of the pixels PX may emit light with a luminance corresponding to a data signal provided through the corresponding data line in response to a scan signal provided through the corresponding scan line. The pixels PX may be externally supplied with voltages of a first power source VDD and a second power source VSS. Here, the first power source VDD and the second power source VSS may provide voltages required for operation of the pixels PX. For example, the first power source VDD may have a voltage level higher than that of the second power source VSS. For example, the second power source VSS may be a ground voltage of 0V and the first power source VDD may be greater than 0V.

The timing controller 200 may receive a control signal CS and first data DATA1 from an external device (e.g., a graphics processor). The external device may also be referred to as a host. Here, the control signal CS may include a clock signal, a vertical synchronization signal, a horizontal synchronization signal, etc.

The timing controller 200 may generate a scan control signal SCS in response to the control signal CS, and may supply the scan control signal SCS to the scan driver 400.

In addition, the timing controller 200 may generate second data DATA2 based on the control signal CS and the first data DATA1, and may supply the second data DATA2 to the data driver 300 through a data clock signal line DPL. In embodiments of the present disclosure, the timing controller 200 may generate a data control signal in response to the control signal CS, may generate frame data based on the control signal CS and the first data DATA1, may configure the second data DATA2 that is one piece of packet data from the data control signal and the frame data, and may supply the second data DATA2 to the data driver 300 through the data clock signal line DPL.

In an embodiment of the present disclosure, the second data DATA2 may be configured as multi-level signal modulation-format packet data.

For example, the second data DATA2 may be configured as pulse amplitude modulation 4-level (PAM4)-format packet data. In this case, the second data DATA2 may have four signal levels (or voltage levels). In an example, the signal levels of the second data DATA2 may correspond to the values of 2-bit data, in other words, '00', '01', '10', and '11'. Here, '00' may be a value in which a least significant bit (LSB) is 0 and a most significant bit (MSB) is 0, '01' may be a value in which an LSB is 1 and an MSB is 0, '10' may be a value in which an LSB is 0 and an MSB is 1, and '11' may be a value in which an LSB is 1 and an MSB is 1. Here, an MSB may correspond to a bit position having the highest value of the second data DATA2, and an LSB may correspond to a bit position having the lowest value of the second data DATA2.

In an example, the second data DATA2 may be configured as pulse amplitude modulation 2-level (PAM2)-format packet data. In this case, the second data DATA2 may have two signal levels (or voltage levels). For example, the signal levels of the second data DATA2 may correspond to the value of 1-bit data, in other words, '0' or '1'.

The signal levels of the second data DATA2 will be described in detail later with reference to FIGS. 4A, 4B, 5A, and 5B.

The data control signal may include a signal required for an initialization operation of the data driver 300, for example, a clock training signal or the like, and the clock training signal may include a clock training pattern. In addition, the frame data may include pixel data or the like.

In an embodiment of the present disclosure, the second data DATA2 may include an adjustment option value. For example, the second data DATA2 may be configured as packet data further including the adjustment option value, together with the above-described data control signal and frame data.

Here, the adjustment option value may be a value used to compensate for signal distortion in the frame data provided to the data driver 300 through the data clock signal line DPL.

For example, a frequency spectrum of second data DATA2 (or frame data included in the second data DATA2) transmitted from the timing controller 200 through the data clock signal line DPL may be attenuated or distorted while being transferred to the data driver 300 through a signal path or the like. In addition, the second data DATA2 flowing into the data driver 300 after passing through the signal path may include jitter. Due to the deterioration of signal quality in such signal transmission, bit information encoded in the second data DATA2 may not be accurately reconstructed (e.g., decoded). In particular, with an increase in the resolution or the like of the display device 1000, the operating frequency of an interface, such as the data clock signal line DPL, increases. As a consequence, data communication is performed in a high frequency band, and thus, loss in high-frequency components of transmission/reception data may become severe.

Accordingly, the timing controller 200 may provide an adjustment option value to compensate for signal distortion in the second data DATA2 (e.g., the frame data of the second data DATA2) to the data driver 300. The data driver 300 may compensate for signal distortion by performing an equalizing operation on the second data DATA2 using the adjustment option value provided from the timing controller 200.

In accordance with embodiments of the present disclosure, the timing controller 200 may provide the adjustment option value once to the data driver 300. The data driver 300 may set an optimal adjustment value using the adjustment option value provided from the timing controller 200 and store the set adjustment value, thus enabling the set adjustment value to be used to compensate for the second data DATA2.

For example, the timing controller 200 may provide the second data DATA2 including the adjustment option value to the data driver 300 during a first period (or a first initialization period). Here, the adjustment option value may include a plurality of option codes. Furthermore, the timing controller 200 may provide second data DATA2 in which the adjustment option value is not included (e.g., second data DATA2 including the data control signal and the frame data) to the data driver 300 during a second period (or a data period) after the first period. In other words, the second data DATA2 provided in the first period may include the adjustment option value and the second data DATA2 provided in the second period may not include the adjustment option value.

Here, the first period (or the first initialization period) may correspond to a period during which the optimal adjustment value is to be set and stored using the option codes included in the adjustment option value after the display device 1000 is supplied with power (or the display device 1000 is powered on). Further, the second period (or the data period) may correspond to a period in which the data driver 300 compensates for signal distortion in each piece of frame data using the stored adjustment value and generates a data signal based on the compensated frame data.

In addition, the timing controller 200 may supply a training notification signal SFC through a common signal line SSL to notify the data driver 300 of a period during which the clock training pattern of the clock training signal is supplied (or a clock training period). For example, the timing controller 200 may supply a training notification signal SFC having a first level (or a logic low level) to the data driver 300 during the clock training period, and may supply a training notification signal SFC having a second level (or a logic high level) higher than the first level to the data driver 300 during periods other than the clock training period.

The data driver 300 may determine a clock training period included in a vertical blank period corresponding to one frame in response to the training notification signal SFC having a first level (or a logic low level) provided from the timing controller 200 through the common signal line SSL. The data driver 300 may generate (or recover) a clock signal based on the second data DATA2 during the clock training period. For example, the data driver 300 may include a clock data recovery circuit (CDR circuit), and the CDR circuit may generate the clock signal in response to the clock training signal for the second data DATA2 during the clock training period.

The data driver 300 may generate data signals based on the second data DATA2 during an active data period corresponding to one frame. For example, the data driver 300 may generate data signals based on both the frame data included in the second data DATA2 and the clock signal generated (or recovered) during the clock training period.

The vertical blank period and the active data period during which the data driver 300 generates the clock signal and the data signals may correspond to the above-described second period (or the data period).

Further, as described above, the data driver 300 may set an optimal adjustment value using the adjustment option value provided from the timing controller 200, and may compensate for signal distortion by performing an equalizing operation on the second data DATA2 using the set adjustment value.

The data driver 300 may supply the data signals to the data lines DL1 to DLm.

The scan driver 400 may receive the scan control signal SCS from the timing controller 200, and may supply scan signals to the scan lines SL1 to SLn in response to the scan control signal SCS. For example, the scan signals may be sequentially supplied to the scan lines SL to SLn.

Each of the scan signals may be set to a gate-on voltage (e.g., a low voltage or a high voltage). A transistor receiving the scan signal may be set to a turn-on state when the scan signal is supplied.

Figure 2:
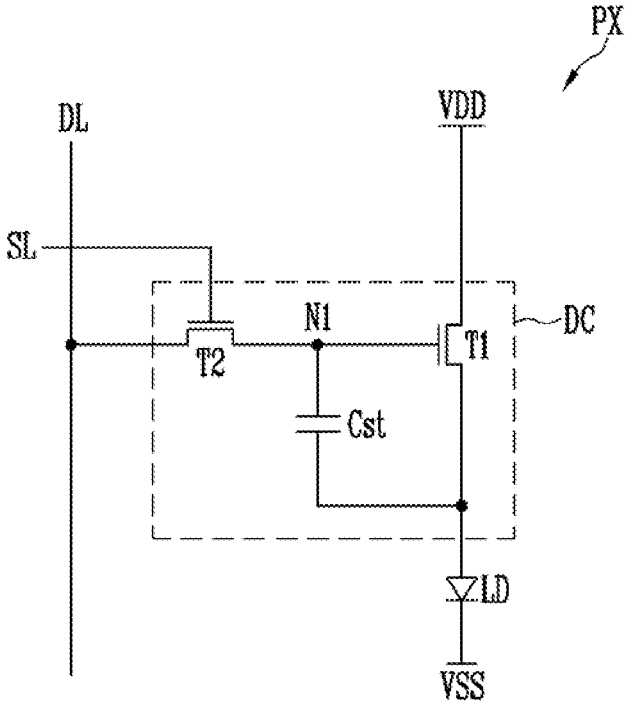
FIG. 2 is a circuit diagram illustrating an example of a pixel included in the display device of FIG. 1.

FIG. 2 is a circuit diagram illustrating an example of a pixel included in the display device of FIG. 1.

Referring to FIG. 2, the pixel PX may include a light-emitting element LD and a driving circuit DC coupled thereto and configured to drive the light-emitting element LD.

A first electrode (e.g., an anode electrode) of the light-emitting element LD may be coupled to a first power source VDD via the driving circuit DC, and a second electrode (e.g., a cathode electrode) of the light-emitting element LD may be coupled to a second power source VSS. The light-emitting element LD may emit light with a luminance corresponding to the amount of driving current controlled by the driving circuit DC.

The light-emitting element LD may be an organic light-emitting diode or an inorganic light-emitting diode such as a micro-light-emitting diode (LED) or a quantum dot light-emitting diode. Further, the light-emitting element LD may be a light-emitting element in which an organic material and an inorganic material are combined with each other. In FIG. 2, the pixel PX is illustrated as including a single light-emitting element LD, but, in other embodiments of the present disclosure, the pixel PX may include a plurality of light-emitting elements, which may be connected in series to each other, in parallel to each other, or in series-parallel to each other.

The first power source VDD and the second power source VSS may have different potentials. For example, a voltage applied through the first power source VDD may be higher than a voltage applied through the second power source VSS.

The driving circuit DC may include a first transistor T1, a second transistor T2, and a storage capacitor Cst.

A first electrode of the first transistor T1 (or driving transistor) may be connected to the first power source VDD, and a second electrode of the first transistor T1 may be electrically connected to the first electrode (e.g., the anode electrode) of the light-emitting element LD. A gate electrode of the first transistor T1 may be coupled to a first node N1. The first transistor T1 may control the amount of driving current to be supplied to the light-emitting element LD in response to a data signal supplied to the first node N1 through a data line DL.

A first electrode of the second transistor T2 (or switching transistor) may be coupled to the data line DL, and a second electrode of the second transistor T2 may be coupled to the first node N1. In other words, the second electrode of the second transistor T2 may be connected to the gate electrode of the first transistor T1. A gate electrode of the second transistor T2 may be coupled to a scan line SL.

The second transistor T2 is turned on when a scan signal having a voltage (e.g., a gate-on voltage) enabling the second transistor T2 to be turned on is supplied from the scan line SL, thus electrically connecting the data line DL and the first node N1 to each other. In this case, a data signal for a corresponding frame may be supplied to the data line DL, and may be transferred to the first node N1. A voltage corresponding to the data signal transferred to the first node N1 may be stored in the storage capacitor Cst.

A first electrode of the storage capacitor Cst may be coupled to the first node N1, and a second electrode of the storage capacitor Cst may be coupled to the first electrode of the light-emitting element LD. The storage capacitor Cst may be charged to a voltage corresponding to the data signal supplied to the first node N1, and may maintain the charged voltage until a data signal for a subsequent frame is supplied.

In FIG. 2, the pixel PX having a relatively simple form is illustrated for convenience of description, and the structure of the driving circuit DC may be changed and implemented in various forms. For example, the driving circuit DC may further include various types of transistors, such 1*o* as a compensation transistor for compensating for the threshold voltage of the first transistor T1, an initialization transistor for initializing the first node N1, and/or an emission control transistor for controlling an emission time of the light-emitting element LD, or other circuit elements, such as a boosting capacitor for boosting the voltage of the first node N1.

Although, in FIG. 2, all of the transistors, e.g., the first and second transistors T1 and T2, included in the driving circuit DC have been illustrated as being N-type transistors, the present disclosure is not limited thereto. For example, at least one of the first and second transistors T1 and T2 included in the driving circuit DC may be replaced with a P-type transistor.

Figure 3:
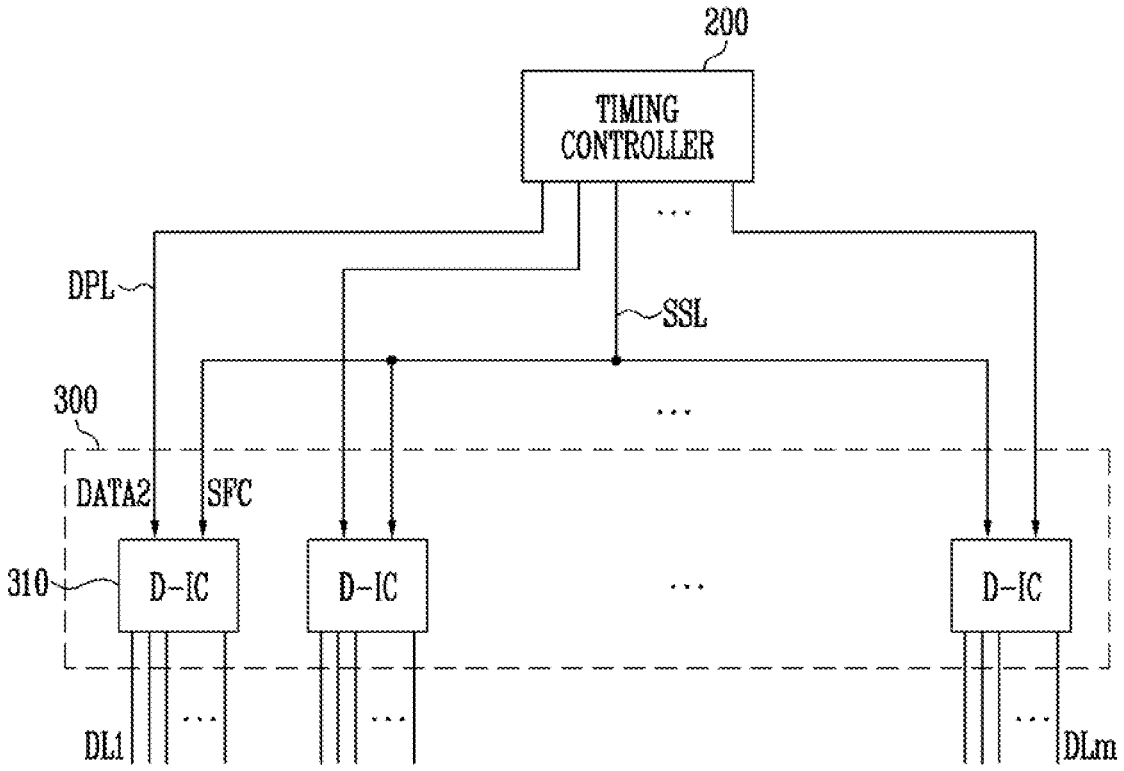
FIG. 3 is a diagram illustrating examples of a data clock signal line and a common signal line for coupling a timing controller and a data driver included in the display device of FIG. 1 to each other.

FIG. 3 is a diagram illustrating examples of a data clock signal line and a common signal line for coupling the timing controller and the data driver included in the display device of FIG. 1 to each other.

Referring to FIG. 3, the data driver 300 may include data driving circuits 310. Here, the data driving circuits 310 may also be called driver integrated circuits (D-IC) or a source IC.

The data driving circuits 310 may be coupled to at least one of the data lines DL1 to DLm. For example, when the data driver 300 includes only the data driving circuit 310, the data driving circuit 310 may be identical to the data driver 300. In this case, all of the data lines DL1 to DLm may be coupled to one data driving circuit 310. In an example, when the data driver 300 includes a plurality of data driving circuits 310, the data lines DL1 to DLm may be grouped, and respective data line groups may be coupled to the data driving circuits 310 corresponding thereto. For example, the data driver 300 may include m data driving circuits 310 identical to the number of data lines DL1 to DLm, wherein each of the data line groups includes one data line, and thus m data driving circuits 310 may be coupled to m data lines DL1 to DLm (or data line groups), respectively. In an example, the data driving circuits 310 may include m/j (where j is an integer that is equal to or greater than 2 and less than m) data driving circuits 310. In this case, each of the data line groups may include j data lines, and m/j data driving circuits 310 may be coupled to j data lines (or data line groups), among m data lines DL1 to DLm.

The timing controller 200 and the data driver 300 may be coupled to each other through a data clock signal line DPL and a common signal line SSL.

In an embodiment of the present disclosure, the timing controller 200 may be coupled to respective data driving circuits 310 included in the data driver 300 through the data clock signal line DPL. For example, a method in which the timing controller 200 is coupled to the data driving circuits 310 included in the data driver 300 through the data clock signal line DPL may be a point-to-point method. In this case, the data clock signal line DPL may include a number of sub-data clock signal lines identical to the number of data driving circuits 310. In other words, the timing controller 200 may be coupled to the data driving circuits 310 through the sub-data clock signal lines, respectively.

The data clock signal line DPL may correspond to an interface for transmission of second data DATA2 provided from the timing controller 200 to the data driver 300 (or the data driving circuits 310). For example, the data clock signal line DPL may be a high-speed serial interface. For example, the data clock signal line DPL may be a universal serial interface (USI), a universal serial interface for TV (USI-T), an ultra path interface (UPI), or universal description, discovery and integration (UDDI).

The second data DATA2 may be data in which a clock is embedded. For example, as described above with reference to FIG. 1, the second data DATA2 may include a data control signal (or a clock training signal) and frame data. Here, since the timing controller 200 and the data driving circuits 310 included in the data driver 300 are coupled to each other through the data clock signal line DPL, the timing controller 200 may supply pieces of second data DATA2 respectively corresponding to the data driving circuits 310 through the data clock signal line DPL.

Further, the second data DATA2 may include an adjustment option value. As described above with reference to FIG. 1, the second data DATA2 including the adjustment option value may be provided from the timing controller 200 to the data driver 300 during a first period (or a first initialization period), after which second data DATA2 including no adjustment option value may be provided from the timing controller 200 to the data driver 300 during a second period (or a data period).

When the data driver 300 includes the plurality of data driving circuits 310, signal distortion in the second data DATA2 transmitted from the timing controller 200 may occur differently for respective data driving circuits 310. For example, because the locations of the data driving circuits 310 in the data driver 300 are different from each other, the length, shape, etc. of the data clock signal line DPL (or sub-data clock signal lines) which couples the timing controller 200 to the data driving circuits 310 may differ between the data driving circuits 310. In addition, since sub-data clock signal lines are coupled to the data driving circuits 310, respectively, there may be a slight difference in signal transmission characteristics of respective sub-data clock signal lines. In other words, some of the data driving circuits 310 may receive signals with more or less distortion than other data driving circuits 310. Therefore, the timing controller 200 may provide adjustment option values (or pieces of second data DATA2 respectively including the adjustment option values) respectively corresponding to the data driving circuits 310 to the corresponding data driving circuits 310, and thus signal distortion may be compensated for with adjustment values (e.g., optimal adjustment values set based on the adjustment option values) suitable for the respective data driving circuits 310. In other words, each of the data driving circuits 310 may be provided with its own adjustment option value specifically tailored to compensate for any signal distortion along its corresponding data clock signal line DPL.

In addition, because the timing controller 200 and the data driving circuits 310 are coupled to each other through the data clock signal line DPL (or sub-data clock signal lines) (e.g., using a point-to-point method), the timing controller 200 may simultaneously supply a plurality of adjustment option values corresponding to the data driving circuits 310 through the corresponding sub-data clock signal lines.

In contrast, when the timing controller 200 and the data driving circuits 310 are coupled in common to each other (e.g., using a multi-drop method as in the case of the common signal line SSL, which will be described later), the timing controller 200 should sequentially transmit the corresponding adjustment option values to the data driving circuits 310 through one signal line coupled in common thereto. In this case, a transmission time during which the adjustment option values are transmitted from the timing controller 200 to the data driving circuits 310 may increase.

In other words, the timing controller 200 of the display device 1000 (see FIG. 1) according to the present embodiment may simultaneously supply pieces of second data DATA2 including respective adjustment option values corresponding to the data driving circuits 310 to the corresponding data clock signal lines DPL (or sub-data clock signal lines), thus shortening the time required for transmission of the adjustment option values (or the data rate for the adjustment option values may be improved).

In addition, as described above with reference to FIG. 1, the common signal line SSL may correspond to a signal transmission channel for transmission of a training notification signal SFC, which is provided from the timing controller 200 to the data driver 300 (or the data driving circuits 310).

In an embodiment of the present disclosure, the timing controller 200 may be coupled in common to the data driving circuits 310 included in the data driver 300 through the common signal line SSL. For example, a method in which the timing controller 200 is coupled to the data driving circuits 310 through the common signal line SSL may be a multi-drop method.

Since the timing controller 200 and the data driving circuits 310 are coupled in common to each other through the common signal line SSL, the timing controller 200 may simultaneously supply the training notification signal SFC, having a first level (or a logic low level) for notification of supply of a clock training signal, to all of the data driving circuits 310 through one common signal line SSL during a clock training period.

Figure 4A:
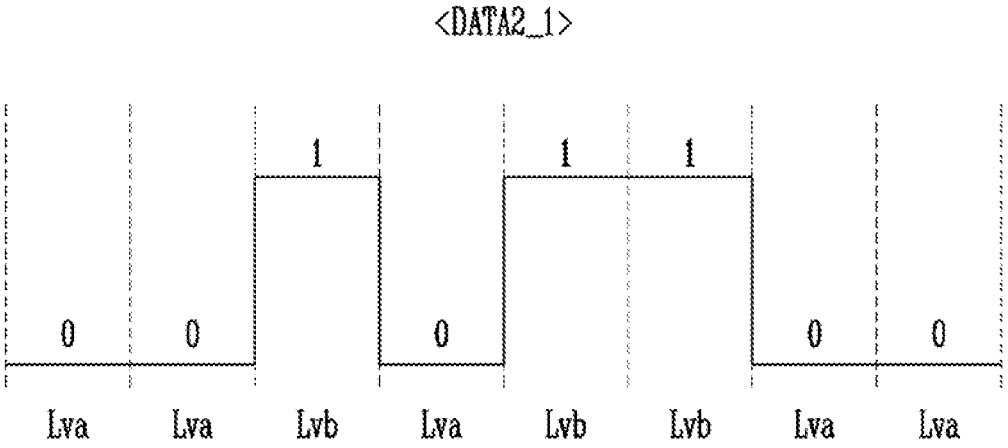
FIGS. 4A and 4B are waveform diagrams illustrating examples of signal levels of second data transmitted through the data clock signal line of FIG. 3.
Figure 4B:
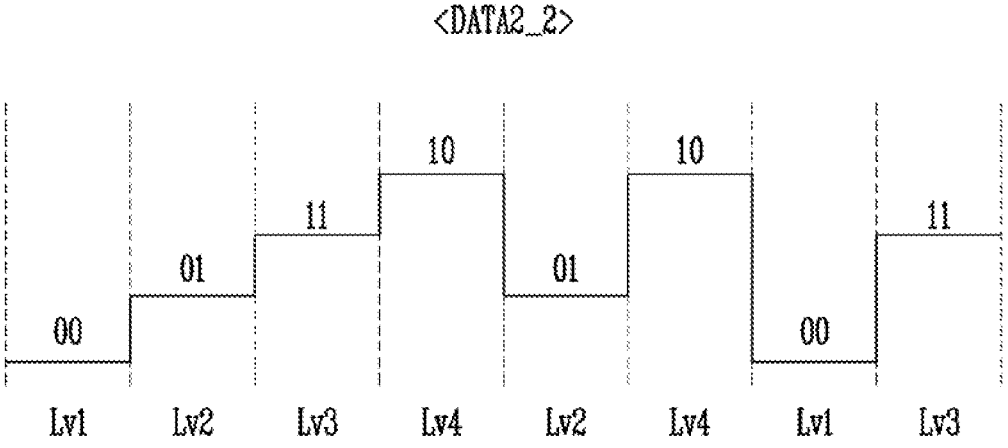
Figure 5A:
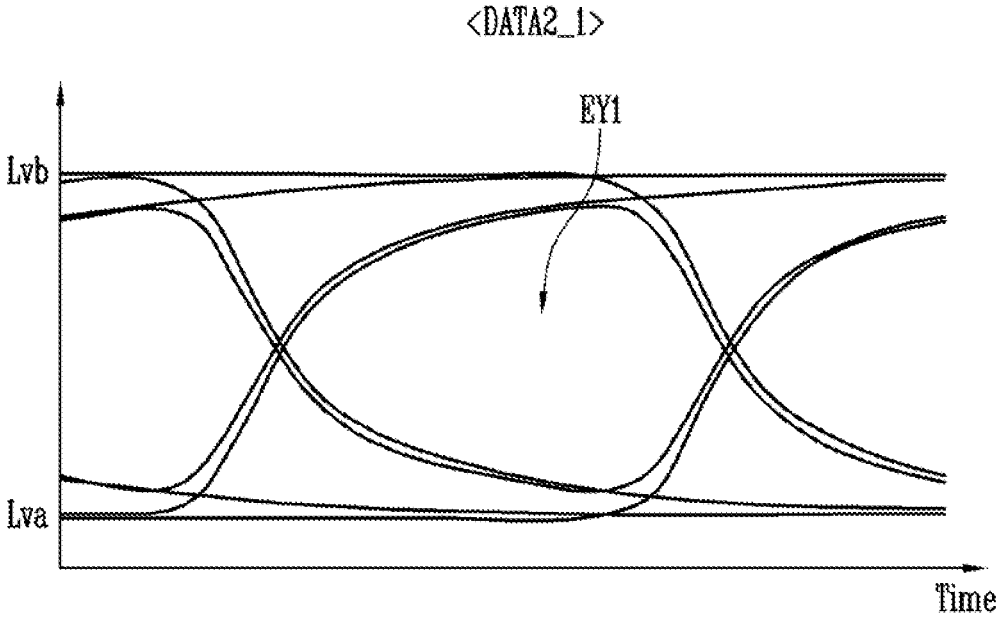
FIGS. 5A and 5B are eye diagrams of second data transmitted through the data clock signal line of FIG. 3.
Figure 5B:
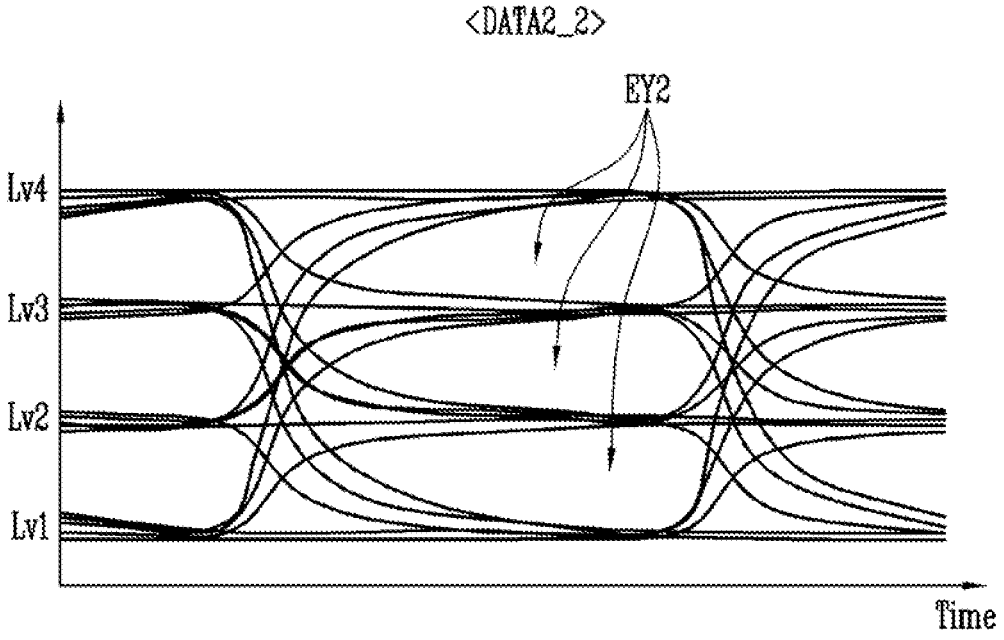

FIGS. 4A and 4B are waveform diagrams illustrating examples of signal levels of second data transmitted through the data clock signal line of FIG. 3. FIGS. 5A and 5B are eye diagrams of second data transmitted through the data clock signal line of FIG. 3. Here, each eye diagram indicates a voltage waveform, in which signals are accumulated and overlap each other, on a time axis.

Referring to FIGS. 3 and 4A, second data DATA2_1 may have two signal levels Lva and Lvb (or two voltage levels). For example, the second data DATA2_1 may have one of data values, signal levels of which may be represented by 1 bit, in other words, a first signal level Lva that is a value of '0' and a second signal level Lvb that is a value of '1'. For example, the second data DATA2_1 may be pulse amplitude modulation 2-level (PAM2)-format packet data, described above with reference to FIG. 1.

As described above, the second data DATA2_1 may correspond to binary code data having 1 bit, in other words, a signal level of 0 (or a low level) or a signal level of 1 (or a high level) in each unit interval.

Referring to FIGS. 3 and 4B, second data DATA2_2 may have four signal levels Lv1, Lv2, Lv3, and Lv4 (or four voltage levels). For example, the second data DATA2_2 may have one of data values, signal levels of which may be represented by 2 bits, in other words, a first signal level Lv1 that is a value of '00', a second signal level Lv2 that is a value of '01', a third signal level Lv3 that is a value of '11', and a fourth signal level Lv4 that is a value of '10'.

In this case, the second data DATA2_2 according to an embodiment of the present disclosure may have 2 bits having a most significant bit and a least significant bit, in other words, one of four signal levels, in each unit interval. For example, the second data DATA2_2 may be PAM4-format packet data, described above with reference to FIG. 1.

The signal levels of the second data DATA2_2 according to embodiments of the present disclosure are not limited thereto. For example, the third signal level Lv3 of the second data DATA2_2 may be a value of '10', and the fourth signal level Lv4 thereof may be a value of '11'.

Hereinafter, as illustrated in FIG. 4B, a description will be made based on the case where the third signal level Lv3 of the second data DATA2_2 is a value of '11' and the fourth signal level Lv4 thereof is a value of '10'.

Because the second data DATA2_2 of FIG. 48 has the number of signal levels (or the number of bits) that is twice that of the signal levels of the second data DATA2_1 of FIG. 4A, a bandwidth may be reduced by half with respect to the same bit rate. Accordingly, data may be more stably transmitted in a high-speed interface.

However, compared to the second data DATA2_1 of FIG. 4A, the second data DATA2_2 of FIG. 4B may have a smaller eye opening size in an eye diagram.

For example, referring further to FIGS. 5A and 5B, the second data DATA2_2 of FIG. 4B may have a number of signal levels greater than the number of signal levels of the second data DATA2_1 of FIG. 4A. Accordingly, the size of eye-opening EY2 in the eye diagram of the second data DATA2_2 illustrated in FIG. 5B may be smaller than the size of eye opening EY1 in the eye diagram of the second data DATA2_1 illustrated in FIG. 5A. Therefore, in the case of the second data DATA2_2 of FIG. 4B, deterioration of signal quality may be more severe than that of the second data DATA2_1 of FIG. 4A.

Accordingly, when the timing controller 200 according to an embodiment of the present disclosure transmits the second data DATA2 to the data driver 300, the timing controller 200 may transmit the second data DATA2 in the form of the second data DATA2_1 of FIG. 4A or the second data DATA2_2 of FIG. 4B depending on the type of signals included in the second data DATA2, in other words, packet data. This will be described in detail with reference to FIGS. 6 to 8.

Figure 6:
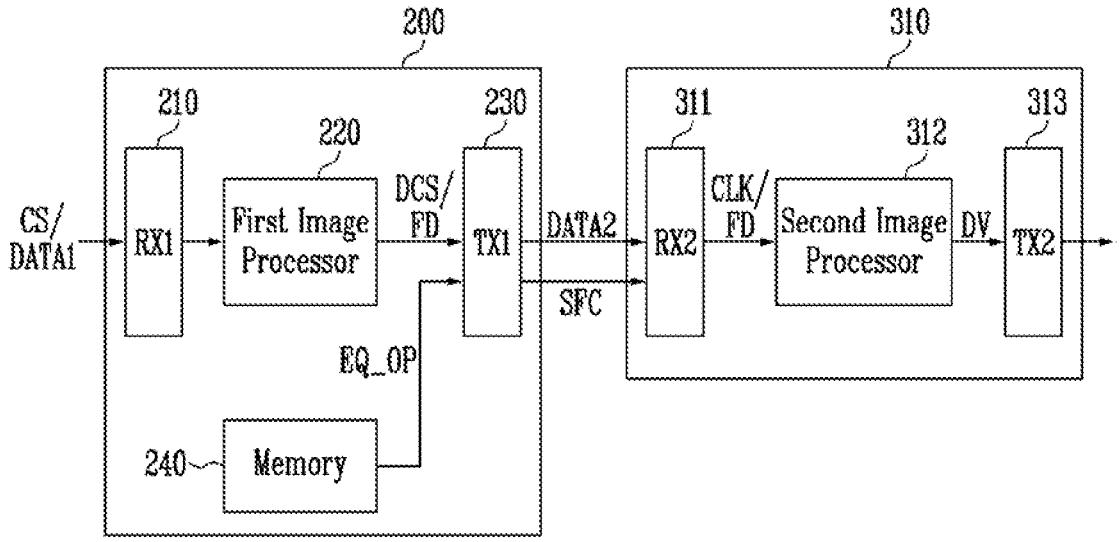
FIG. 6 is a block diagram illustrating examples of the timing controller and a data driving circuit included in the data driver in FIG. 3.
Figure 7:
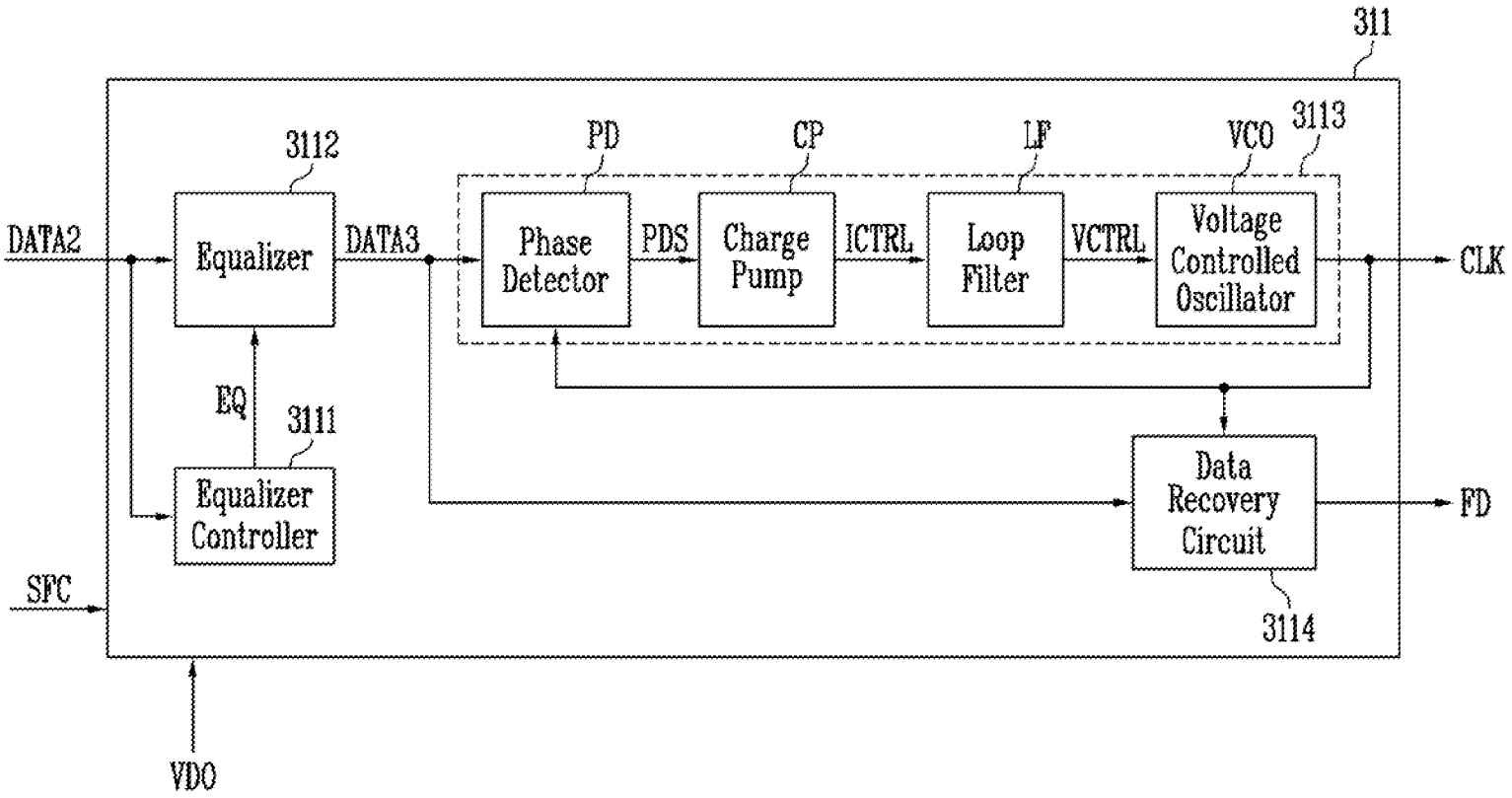
FIG. 7 is a block diagram illustrating an example of a second receiver included in the data driving circuit of FIG. 6.

FIG. 6 is a block diagram illustrating examples of the timing controller and a data driving circuit included in the data driver in FIG. 3. FIG. 7 is a block diagram illustrating an example of a second receiver included in the data driving circuit of FIG. 6. Since the data driving circuits 310 of FIG. 3 are identical or similar to each other, a description will be made based on a representative one of the data driving circuits 310 in FIG. 6.

Referring to FIGS. 3 and 6, a timing controller 200 may include a first receiver 210, a first image signal processor (first image processor) 220, and a first transmitter 230.

The first receiver 210 may receive a control signal CS and first data DATA1 from an external device (e.g., a graphics processor) and provide the control signal CS and the first data DATA1 to the first image processor 220. For example, the first receiver 210 may constitute one interface system together with a transmitter of the graphics processor, and may include a reception circuit corresponding to the transmitter of the graphics processor. Here, the control signal CS may include a clock signal CLK or the like, which will be described later.

The first image processor 220 may realign the first data DATA1 in response to a clock signal CLK included in the control signal CS, and may then generate frame data FD. For example, the first image processor 220 may include a serializer.

The first image processor 220 may generate a data control signal DCS in response to the control signal CS. The data control signal DCS may include a clock training signal, described above with reference to FIG. 1.

The first transmitter 230 may transmit the data control signal DCS and the frame data FD to the data driving circuit 310 through a data clock signal line DPL. For example, as described above with reference to FIG. 1, the first transmitter 230 may transmit the data control signal DCS to the data driving circuit 310 during a vertical blank period corresponding to one frame, and may transmit the frame data FD to the data driving circuit 310 during an active data period corresponding to one frame. Here, the data control signal DCS and the frame data FD may be transmitted as the second data DATA2, which is one piece of packet data, through the data clock signal line DPL.

Further, the first transmitter 230 may provide a training notification signal SFC to the data driving circuit 310 through the common signal line SSL to provide notification of a clock training period in response to the data control signal DCS. For example, the first transmitter 230 may provide the training notification signal SFC having a first level (or a logic low level) to the data driving circuit 310 during the clock training period, and may provide the training notification signal SFC having a second level (or a logic high level) to the data driving circuit 310 during periods other than the clock training period.

In an embodiment of the present disclosure, the timing controller 200 may further include a memory 240.

The memory 240 may store an adjustment option value EQ_OP corresponding to the data driving circuit 310 provided with the second data DATA2 through the data clock signal line DPL.

As described above with reference to FIG. 3, when the data driver 300 includes a plurality of data driving circuits 310, signal distortion in the second data DATA2 transmitted from the timing controller 200 differs for respective data driving circuits 310, and thus the memory 240 may include adjustment option values EQ_OP respectively corresponding to the data driving circuits 310. In other words, the memory 240 may include an adjustment option value EQ_OP for each of the data driving circuits 310.

The first transmitter 230 may be provided with the corresponding adjustment option value EQ_OP from the memory 240, may configure one piece of packet data from the adjustment option value EQ_OP, together with the data control signal DCS and the frame data FD, and may then supply the second data DATA2 to the data driving circuit 310 through the data clock signal line DPL.

In an embodiment of the present disclosure, as described above with reference to FIG. 1, the timing controller 200 may provide the second data DATA2 including the adjustment option value EQ_OP once to the data driving circuit 310, during a first period (or a first initialization period).

In this case, the memory 240 may provide the adjustment option value EQ_OP stored therein to the first transmitter 230 during the first period (or the first initialization period). In addition, the first transmitter 230 may supply the second data DATA2 configured to include the adjustment option value EQ_OP to the data driving circuit 310 through the data clock signal line DPL during the first period.

The memory 240 does not provide an adjustment option value EQ_OP to the first transmitter 230 during a second period (or a data period) after the first period. In this case, the first transmitter 230 may supply the second data DATA2 including no adjustment option value EQ_OP to the data driving circuit 310 through the data clock signal line DPL during the second period. During the second period, the second data DATA2 may include a data control signal DCS and frame data FD which correspond to each frame.

Further, as described above with reference to FIGS. 3, 4A, 4B, 5A, and 5B, the first transmitter 230 of the timing controller 200 may change the format of the second data DATA2 depending on the type of signals included in the packet data, and may supply the format-changed second data DATA2 to the data driving circuit 310.

For example, during the first period in which the second data DATA2 including the adjustment option value EQ_OP is transmitted, the first transmitter 230 may provide the second data DATA2_1, described above with reference to FIGS. 4A and 5A. In other words, the first transmitter 230 may provide the second data DATA2 having two signal levels that can be represented by 1 bit, to the data driving circuit 310. Here, the first period may be a period (e.g., a first initialization period) during which the timing controller 200 transmits the second data DATA2 including the adjustment option value EQ_OP to the data driving circuit 310 and during which the data driving circuit 310 sets and stores an optimal adjustment value using the adjustment option value EQ_OP. In the first period, transmission of the adjustment option value EQ_OP (in other words, second data including the adjustment option value EQ_OP) for minimizing the deterioration of signal quality, rather than the high-speed transmission of data, may be required. Accordingly, during the first period, the first transmitter 230 of the timing controller 200 may transmit the second data DATA2 (e.g., second data DATA2_1 of FIG. 4A) having two signal levels (e.g., two signal levels that can be represented by 1 bit) to the data driving circuit 310 through the data clock signal line DPL.

During a second period after the first period, the first transmitter 230 may provide second data DATA2_2, described above with reference to FIGS. 4B and 5B, in other words, the second data DATA2 having four signal levels that can be represented by 2 bits, to the data driving circuit 310. Here, the second period may be a period during which second data DATA2, which does not include an adjustment option value EQ_OP and includes a data control signal DCS and frame data FD corresponding to each frame, is transmitted. In the second period, transmission of the second data DATA2 for the high-speed transmission of data may be required. Here, since the data driving circuit 310 stores an optimal adjustment value during the first period and uses the stored optimal adjustment value to compensate for the second data DATA2 during the second period, deterioration of signal quality of the second data DATA2 may be compensated for by using the stored optimal adjustment value even if the signal quality of the second data DATA2 is slightly deteriorated due to high speed data transmission. Accordingly, during the second period, the first transmitter 230 of the timing controller 200 may transmit the second data DATA2 (e.g., second data DATA2_2 of FIG. 4B) having four signal levels (e.g., four signal levels that can be represented by 2 bits) to the data driving circuit 310 through the data clock signal line DPL.

The data driving circuit 310 may include a second receiver 311, a second image signal processor (second image processor) 312, and a second transmitter 313.

The second receiver 311 may receive the second data DATA2 from the timing controller 200 (or the first transmitter 230) through the data clock signal line DPL, and may receive a training notification signal SFC from the timing controller 200 through the common signal line SSL.

To describe the second receiver 311 in detail, a reference is further made to FIG. 7. In other words, the second receiver 311 may include an equalization controller (e.g., equalizer controller) 3111, an equalizer 3112, a clock recovery circuit 3113, and a data recovery circuit 3114.

The equalizer controller 3111 may receive the second data DATA2, and may set an optimal adjustment value EQ using a plurality of option codes included in the adjustment option value EQ_OP. For example, the equalizer controller 3111 may include a counter circuit or the like, and may set an option code having a shortest lock time, among the plurality of option codes, as the optimal adjustment value EQ.

The equalizer controller 3111 may store the set optimal adjustment value EQ. For example, the equalizer controller 3111 may include a processor register.

During a second period after the first period, the equalizer controller 3111 may provide the stored optimal adjustment value EQ to the equalizer 3112.

The equalizer 3112 may receive the second data DATA2 from the first transmitter 230 of the timing controller 200, and may generate third data DATA3 based on the adjustment value EQ. For example, the equalizer 3112 may control the frequency gain of the second data DATA2 based on the adjustment value EQ, and may then generate the third data DATA3.

The clock recovery circuit 3113 may receive the third data DATA3 from the equalizer 3112 and then generate (or recover) a clock signal CLK, and the data recovery circuit 3114 may receive the third data DATA3 from the equalizer 3112 and then generate (or recover) the frame data FD using the clock signal CLK generated by the clock recovery circuit 3113.

The clock recovery circuit 3113 may include a phase detector PD, a charge pump CP, a loop filter LF, and a voltage-controlled oscillator VCO.

The phase detector PD may detect a phase difference between the third data DATA3 and the clock signal CLK, and may output a phase difference signal PDS. The charge pump CP may output a current control signal ICTRL based on the phase difference signal PDS provided from the phase detector PD. The loop filter LF may output a voltage control signal VCTRL corresponding to the current control signal ICTRL. The voltage-controlled oscillator VCO may output the clock signal CLK having a frequency corresponding to the voltage level of the voltage control signal VCTRL.

The clock recovery circuit 3113 and the data recovery circuit 3114 may constitute the clock data recovery circuit (CDR circuit), described above with reference to FIG. 1.

Referring back to FIG. 6, the second image processor 312 may receive the clock signal CLK and the frame data FD from the second receiver 311.

The second image processor 312 may generate data signals DV corresponding to the frame data FD using the clock signal CLK, and the second transmitter 313 may provide the data signals DV to data lines DL1 to DLm (see FIG. 3).

For example, the second image processor 312 may include a deserializer configured to rearrange serially transmitted data in parallel, a shift register configured to sequentially output the rearranged data, a data latch, and a digital-to-analog converter (DAC) configured to convert digital data into an analog data signal.

Figure 8:
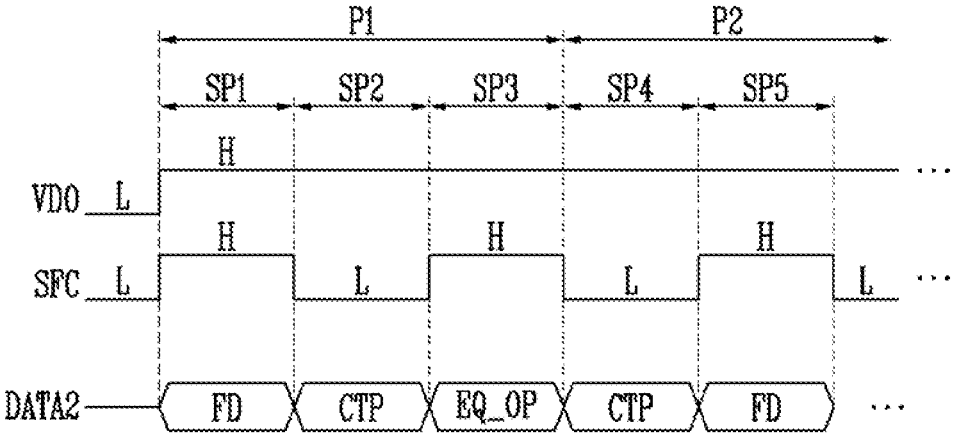
FIG. 8 is a diagram illustrating an example of second data transmitted through the data clock signal line of FIG. 3.

FIG. 8 is a diagram illustrating an example of second data transmitted through the data clock signal line of FIG. 3. A first period P1 illustrated in FIG. 8 may correspond to a first initialization period during which an optimal adjustment value EQ is to be set and stored using option codes included in an adjustment option value EQ_OP, after a display device 1000 (see FIG. 1) is supplied with power (or is powered on). A second period P2 may correspond to a data period during which the data driving circuit 310 (or the data driver 300) compensates for signal distortion in each piece of frame data FD using the stored optimal adjustment value EQ and the data signals DV are generated based on the compensated frame data (e.g., third data DATA3).

Referring to FIGS. 6 to 8, a driving supply voltage VDO may make a transition from a logic low level L to a logic high level H during a first period P1 (or a first initialization period). When the driving supply voltage VDO having a logic high level H is applied (e.g., when the display device 1000 (see FIG. 1) is powered on), the data driving circuit 310 may be operated.

The driving supply voltage VDO may be maintained at a logic high level H while the display device 1000 (see FIG. 1) is being driven, e.g., during the first period P1 and the second period P2 (or the data period) after the first period P1.

During the first period P1 in which the adjustment value EQ is to be set and stored, the second data DATA2 may include frame data FD and a clock training signal CTP in response to a training notification signal SFC. For example, during a second sub-period SP2 in which the training notification signal SFC has a logic low level L, the timing controller 200 may supply the clock training signal CTP (or a clock training pattern) as the second data DATA2 to the data driving circuit 310. Further, during a first sub-period SP1 in which the training notification signal SFC has a logic high level H, the timing controller 200 may supply the frame data FD as the second data DATA2 to the data driving circuit 310.

In an embodiment of the present disclosure, in the first period P1, the second data DATA2 may include the adjustment option value EQ_OP. For example, in the first period P1 corresponding to the first initialization period, during a third sub-period SP3 in which the training notification signal SFC has a logic high level H after the clock training period (e.g., the second sub-period SP2), the timing controller 200 may supply the adjustment option value EQ_OP to the data driving circuit 310.

The data driving circuit 310 may set and store the optimal adjustment value EQ using the adjustment option value EQ_OP supplied during the third sub-period SP3 of the first initialization period.

Thereafter, in the second period P2 during which the second data DATA2 is to be compensated for by using the adjustment value EQ and the data signals DV are to be generated, the second data DATA2 may include the frame data FD and the clock training signal CTP in response to the training notification signal SFC. For example, during a fourth sub-period SP4 in which the training notification signal SFC has a logic low level L, the timing controller 200 may supply the clock training signal CTP (or a clock training pattern) as the second data DATA2 to the data driving circuit 310. Further, during a fifth sub-period SP5 in which the training notification signal SFC has a logic high level H, the timing controller 200 may supply the frame data FD as the second data DATA2 to the data driving circuit 310.

As described above with reference to FIGS. 6 and 7, during the second period P2, whenever second data DATA2 corresponding to each frame is received by the data driving circuit 310 (e.g., in each frame), the data driving circuit 310 may compensate for the second data DATA2 using the adjustment value EQ set and stored during the first period P1 (or generate the third data DATA3).

After the fifth sub-period SP5 in the second period P2, periods substantially identical to the fourth sub-period SP4 during which the clock training signal CTP is supplied and the fifth sub-period SP5 during which the frame data FD is supplied may be repeated in each frame.

As described above with reference to FIGS. 1 to 8, the display device 1000 according to embodiments of the present disclosure may transmit the adjustment option value EQ_OP, which is supplied from the timing controller 200 to the data driver 300 (or the data driving circuit 310), through the data clock signal line DPL without utilizing a separate line. Accordingly, a separate line for transmitting the adjustment option value EQ_OP may be omitted, whereby the number of signal lines required for signal transmission between the timing controller 200 and the data driver 300 may be reduced.

Further, because the timing controller 200 and the data driving circuits 310 are coupled to each other through the data clock signal line DPL (or sub-data clock signal lines), the timing controller 200 may simultaneously supply a plurality of adjustment option values EQ_OP corresponding to the data driving circuits 310 through the corresponding sub-data clock signal lines. Accordingly, the time required for transmission of the adjustment option values EQ_OP may be shortened (or a data rate for the adjustment option values EQ_OP may be improved).

Figure 9:
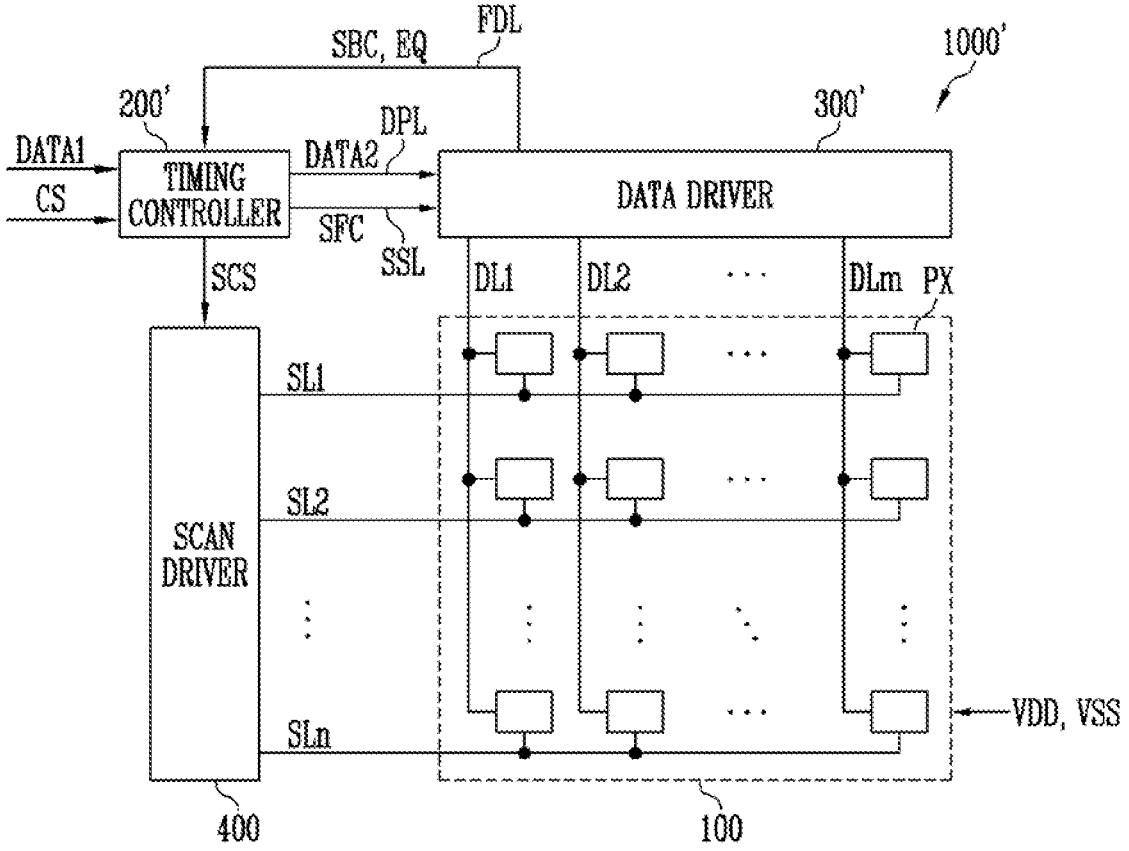
FIG. 9 is a block diagram illustrating a display device according to an embodiment of the present disclosure.
Figure 10:
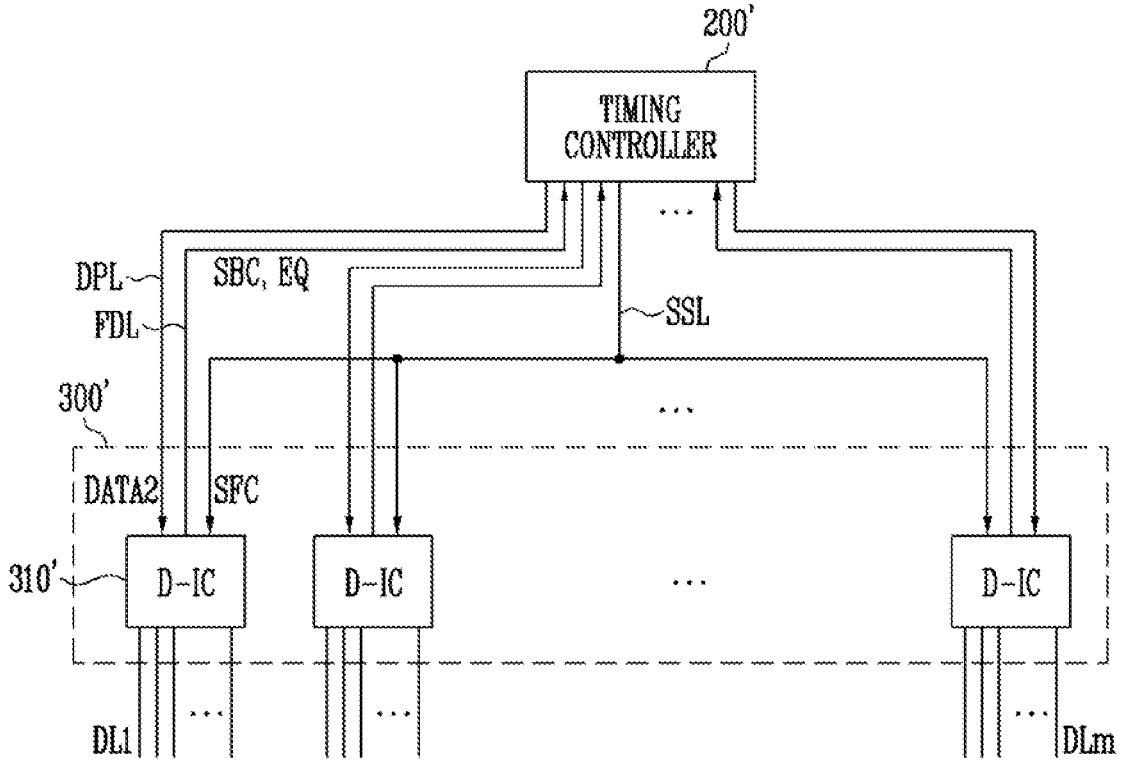
FIG. 10 is a diagram illustrating examples of a data clock signal line, a common signal line, and a feedback line for coupling a timing controller and a data driver included in the display device of FIG. 9 to each other.
Figure 11:
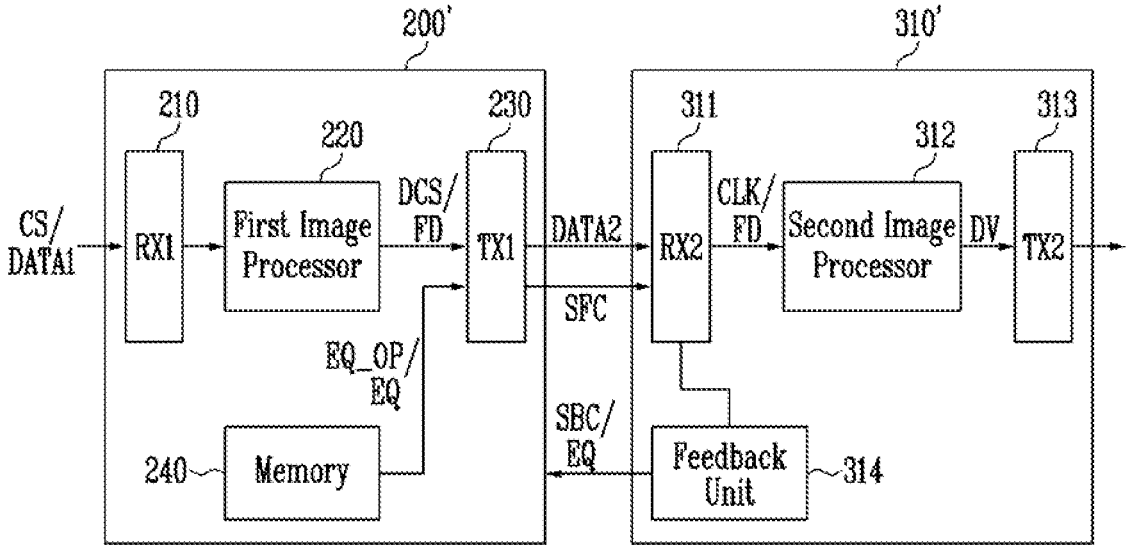
FIG. 11 is a block diagram illustrating examples of the timing controller and a data driving circuit included in the data driver in FIG. 10.

FIG. 9 is a block diagram illustrating a display device according to an embodiment of the present disclosure. FIG. 10 is a diagram illustrating examples of a data clock signal line, a common signal line, and a feedback line for coupling a timing controller and a data driver, which are included in the display device of FIG. 9, to each other. FIG. 11 is a block diagram illustrating examples of the timing controller and a data driving circuit included in the data driver in FIG. 10. Except for some components, a display device 1000' of FIG. 9 is substantially identical or similar to the display device 1000 of FIG. 1, and thus repeated descriptions thereof will be omitted in FIGS. 9 to 11.

An embodiment of the present disclosure provides a display device 1000 including: a timing controller 200 configured to supply an adjustment option value EQ_OP through a data clock signal line DPL during a first initialization period, and generate second data DATA2 based on first data DATA1 and a control signal CS and supply the second data DATA2 through the data clock signal line DPL during a data period; a data driver 300 configured to generate an adjustment value EQ based on the adjustment option value EQ_OP during the first initialization period, and generate third data DATA3 based on the adjustment value EQ and the second data DATA2 and generate a data signal DV based on the third data DATA3 during the data period; and a pixel PX configured to display an image based on the data signal DV.

Referring to FIGS. 9 to 11, when a failure situation, such as deletion of an adjustment value EQ stored in a data driver 300' due to an external electrostatic discharge (ESD) stress or the like, occurs during a second period (or a data period) of the display device 1000' according to an embodiment of the present disclosure, a timing controller 200' may supply an optimal adjustment value EQ, provided by the data driver 300' during the first period (or the first initialization period), to the data driver 300' through the data clock signal line DPL during a third period (or a second initialization period) after the failure situation. The data driver 300' may again store the adjustment value EQ supplied from the timing controller 200' during the third period, and may compensate for signal distortion in the second data DATA2 using the adjustment value EQ. In other words, the adjustment value EQ may be restored in the data driver 300'.

For this operation, the display device 1000' may further include a feedback line FDL for signal transmission between the timing controller 200' and the data driver 300' (or data driving circuit 310'). In accordance with embodiments of the present disclosure, the timing controller 200' may be coupled to the data driving circuits 310' through feedback lines FDL, respectively. For example, the feedback lines FDL may couple the timing controller 200' to the data driving circuits 310', respectively, using a point-to-point method, described above with reference to FIG. 3. However, the embodiment of the present disclosure is not limited thereto, and the timing controller 200' may be coupled in common to the data driving circuits 310' through the feedback line FDL. For example, the feedback line FDL may couple the timing controller 200' and the data driving circuits 310' in common to each other using a multi-drop method, described above with reference to FIG. 3.

Furthermore, each data driving circuit 310' (or the data driver 300') may further include a feedback unit 314.

The data driver 300' (or each data driving circuit 310') may supply a feedback signal SBC and an adjustment value EQ to the timing controller 200' through the feedback line FDL.

For example, as described above with reference to FIGS. 1 to 8, the data driver 300' may set and store an optimal adjustment value EQ using an adjustment option value EQ_OP supplied from the timing controller 200' during the first period P1 (or the first initialization period). In this case, the data driver 300' may supply the set optimal adjustment value EQ to the timing controller 200' through the feedback line FDL.

For this operation, the feedback unit 314 included in the data driving circuit 310' may be coupled to the second receiver 311 and provided with the adjustment value EQ set by the equalizer controller 3111 of the second receiver 311, and may supply the provided adjustment value EQ to the timing controller 200' through the feedback line FDL.

The memory 240 of the timing controller 200' may store the adjustment value EQ supplied from the data driving circuit 310'.

Thereafter, during the second period (or the data period), a failure situation, such as the case where the adjustment value EQ stored in the data driving circuit 310' (or the equalizer controller 3111) is deleted due to an external electrostatic discharge (ESD) stress or the like, may occur.

In this case, the feedback unit 314 of the data driving circuit 310' may provide a feedback signal SBC to the timing controller 200' in response to the deletion of the adjustment value EQ through the feedback line FDL.

When the feedback signal SBC is received from the data driving circuit 310', the timing controller 200' may supply the adjustment value EQ, stored in the memory 240 during the previous first period, to the data driving circuit 310' through the data clock signal line DPL during a third period (or a second initialization period) after the failure situation. For example, the memory 240 may provide the adjustment value EQ stored therein to the first transmitter 230 in response to the feedback signal SBC, and the first transmitter 230 may supply the adjustment value EQ to the data driving circuit 310' through the data clock signal line DPL during the third period (or the second initialization period). For example, the first transmitter 230 may supply the adjustment value EQ as the second data DATA2 through the clock signal line DPL.

Thereafter, the second receiver 311 of the data driving circuit 310' may receive the adjustment value EQ, and the equalizer controller 3111 of the second receiver 311 may again store the adjustment value EQ of the second data DATA2.

Figure 12:
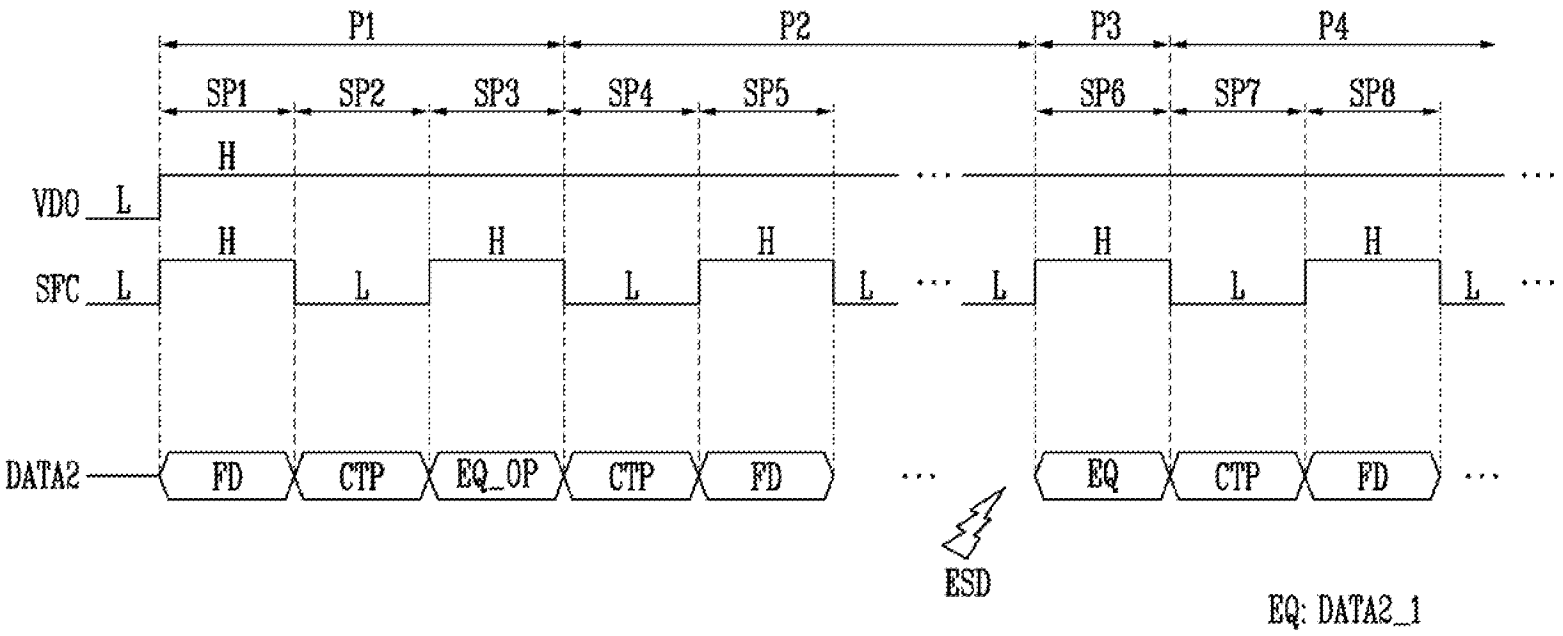
FIG. 12 is a diagram illustrating an example of second data transmitted through the data clock signal line of FIG. 10.
Figure 13:
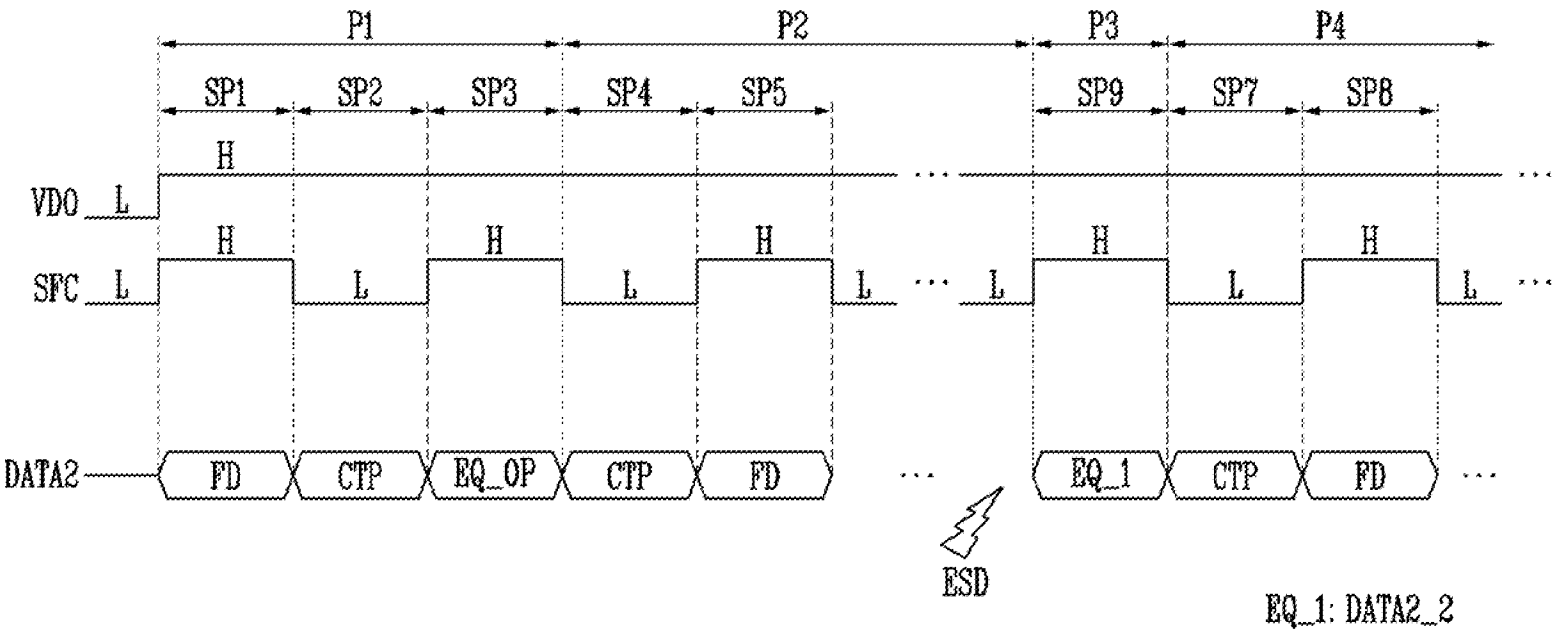
FIG. 13 is a diagram illustrating an example of second data transmitted through the data clock signal line of FIG. 10.

FIG. 12 is a diagram illustrating an example of second data transmitted through the data clock signal line of FIG. 10. FIG. 13 is a diagram illustrating an example of second data transmitted through the data clock signal line of FIG. 10. In FIGS. 12 and 13, repeated descriptions identical to those of FIG. 8 will be omitted.

Referring to FIGS. 9 to 12, during a second period P2 (or a data period), a failure situation in which an adjustment value EQ stored in the equalizer controller 3111 of the data driving circuit 310' is deleted due to an external electrostatic discharge (ESD) stress or the like may occur.

In this case, during a sixth sub-period SP6 in which a training notification signal SFC has a logic high level H in a third period P3 corresponding to a second initialization period after the occurrence of the failure situation, the timing controller 200' may supply the adjustment value EQ to the data driving circuit 310', and the data driving circuit 310' may again store the supplied adjustment value EQ.

After the adjustment value EQ is stored again in the data driving circuit 310' during the second initialization period (or the third period P3), a data period (or a fourth period P4) substantially identical the second period P2, described above with reference to FIG. 8, may be repeated. For example, during a seventh sub-period SP7 in which the training notification signal SFC has a logic low level L, the timing controller 200' may supply a clock training signal CTP (or a clock training pattern) as the second data DATA2 to the data driving circuit 310'. Further, during an eighth sub-period SP8 in which the training notification signal SFC has a logic high level H, the timing controller 200' may supply frame data FD as the second data DATA2 to the data driving circuit 310'.

In an embodiment of the present disclosure, during the third period P3 in which the second data DATA2 including the adjustment value EQ is transmitted, the first transmitter 230 of the timing controller 200' may provide second data DATA2_1, described above with reference to FIGS. 4A and 5A, in other words, second data DATA2 having two signal levels (e.g., two signal levels that can be represented by 1 bit), to the data driving circuit 310'. Similar to the first initialization period, the second initialization period (e.g., the third period P3) is a period for transmission of the adjustment value EQ, and thus the transmission of the adjustment value EQ, by which minimization of deterioration of signal quality is realized, rather than high speed transmission of data, may be required. Accordingly, during the third period P3, the first transmitter 230 of the timing controller 200' may transmit the second data DATA2 having two signal levels (e.g., second data DATA2_1 of FIG. 4A) to the data driving circuit 310' through the data clock signal line DPL However, the embodiment of the present disclosure is not limited thereto.

In an embodiment of the present disclosure, referring to FIG. 13, during a third period P3 (or a ninth sub-period SP9) in which second data DATA2 including an adjustment value EQ_1 is transmitted, the first transmitter 230 of the timing controller 200' may provide the second data DATA2_2, described above with reference to FIGS. 4B and 51, in other words, second data DATA2 having four signal levels that can be represented by 2 bits, to the data driving circuit 310. For example, since the second period P2 may be a period during which the timing controller 200' transmits second data DATA2 having four signal levels (e.g., four signal levels that can be represented by 2 bits) to transmit data at high speed, the timing controller 200' may supply the adjustment value EQ_1, as the second data DATA2 having four signal levels, to the data driving circuit 310' during the third period P3 to maintain a high data transmission speed.

In an example, the timing controller 200' may primarily supply the adjustment value EQ_1, as the second data DATA2 having four signal levels, to the data driving circuit 310' during the third period P3 to maintain a high transmission speed (e.g., a high data rate), as illustrated in FIG. 13, and may secondarily supply the adjustment value EQ, as the second data DATA2 having two signal levels, to the data driving circuit 310' during the third period P3, as illustrated in FIG. 12, when signal distortion in the supplied adjustment value EQ_1 is severe.

A display device according to embodiments of the present disclosure may transmit an adjustment option value required for an adjustment circuit, such as an equalizer, to a data driver through a data clock signal line through which a clock training signal and frame data are transmitted. Accordingly, since a separate signal line for transmitting an adjustment option value may be omitted, the number of signal lines for signal transmission between a timing controller and a data driver may be reduced.

Further, the display device according to embodiments of the present disclosure may simultaneously transmit adjustment option values to data driving circuits corresponding thereto through data clock signal lines to which a timing controller and the data driving circuits are respectively coupled. Accordingly, a data rate for adjustment option values may be improved.

Although the embodiments of the present disclosure have been described, those skilled in the art will appreciate that the present disclosure may be modified and changed in various ways without departing from the spirit and scope of the present disclosure as set forth in the accompanying claims.

What is claimed is:

1. A display device, comprising:

a timing controller configured to supply an adjustment option value through a data clock signal line during a first initialization period, and generate second data based on first data and a control signal and supply the second data through the data clock signal line during a data period;

a data driver configured to generate an adjustment value based on the adjustment option value during the first initialization period, and generate third data based on the adjustment value and the second data and generate a data signal based on the third data during the data period, wherein the adjustment option value has two signal levels, and wherein the second data has four signal levels, and a pixel configured to display an image based on the data signal, wherein the data driver stores the adjustment value and supplies the adjustment value to the timing controller through a feedback line during the first initialization period.

2. The display device according to claim 1, wherein the data driver comprises:

a receiver configured to receive the adjustment option value and the second data through the data clock signal line, and generate a clock signal and frame data based on the adjustment option value and the second data; and an image processor configured to generate the data signal based on the clock signal and the frame data.

3. The display device according to claim 2, wherein the receiver comprises:

an equalizer controller configured to generate the adjustment value using the adjustment option value during the first initialization period;

an equalizer configured to generate the third data by compensating for the second data using the adjustment value during the data period; and a clock recovery circuit configured to recover the clock signal based on the third data during the data period and a data recovery circuit configured to recover the frame data based on the third data during the data period.

4. The display device according to claim 3, wherein the equalizer controller generates the adjustment value using a plurality of option codes included in the adjustment option value.

5. The display device according to claim 1, wherein the timing controller comprises:

a memory configured to store the adjustment value supplied through the feedback line.

6. The display device according to claim 5, wherein the timing controller supplies the adjustment value to the data driver through the data clock signal line during a second initialization period.

7. The display device according to claim 6, wherein the adjustment value supplied through the data clock signal line has two signal levels.

8. The display device according to claim 6, wherein the adjustment value supplied through the data clock signal line has four signal levels.

9. The display device according to claim 6, wherein the data driver supplies a feedback signal to the timing controller through the feedback line when the stored adjustment value is deleted.

10. The display device according to claim 9, wherein the timing controller supplies the adjustment value to the data driver through the data clock signal line in response to the feedback signal during the second initialization period.

11. A method of driving a display device including a timing controller and a data driver, the method comprising:

supplying, by the timing controller, an adjustment option value to the data driver through a data clock signal line during a first initialization period, wherein the adjustment option value has two signal levels;

generating, by the data driver, an adjustment value based on the adjustment option value during the first initialization period;

generating, by the timing controller, second data based on first data and a control signal and supplying the second data to the data driver through the data clock signal line during a data period, wherein the second data has four signal levels;

generating, by the data driver, third data based on the adjustment value and the second data and generating a data signal based on the third data during the data period;

displaying an image based on the data signal; and supplying, by the data driver, the adjustment value to the timing controller through a feedback line during the first initialization period.

12. The method according to claim 11, further comprising:

supplying, by the timing controller, the adjustment value to the data driver through the data clock signal line during a second initialization period.

13. The method according to claim 12, wherein the adjustment value supplied through the data clock signal line has two signal levels.

14. The method according to claim 12, wherein the adjustment value supplied through the data clock signal line has four signal levels.

* * * * *